United States Patent [19]

Kalve

[11] 4,329,795

[45] May 18, 1982

[54] LOAD STRESS RELIEF FOR WALKING DRAGLINE EXCAVATOR BASE FRAMES

[76] Inventor: Ernest Kalve, Camp Lake, Wis. 53109

[21] Appl. No.: 178,940

[22] Filed: Aug. 18, 1980

[51] Int. Cl.[3] ..... E02F 3/48; E02F 3/32

[52] U.S. Cl. ..... 37/116; 212/175; 212/253; 308/227; 414/570; 414/643; 414/648

[58] Field of Search ..... 37/115, 116, 117; 212/175, 223, 234, 253, 247; 414/744, 680, 681, 569–570, 567, 564, 643, 648, 577; 248/544, 648; 308/227, 230, 178, 182, 184 R

[56] References Cited

U.S. PATENT DOCUMENTS

| | | | |
|---|---|---|---|
| 1,635,689 | 7/1927 | Rauch | 212/253 X |
| 2,049,653 | 8/1936 | Ljungkull | 212/175 |
| 2,068,555 | 1/1937 | Ljungkull | 212/175 X |
| 2,408,378 | 10/1946 | Davenport et al. | 212/253 |
| 3,888,357 | 6/1975 | Bauer et al. | 212/175 |
| 4,037,894 | 7/1977 | Sankey | 212/253 |
| 4,038,765 | 8/1977 | Sankey et al. | 37/116 |
| 4,231,699 | 11/1980 | Thompson | 212/253 X |

FOREIGN PATENT DOCUMENTS

| | | | |
|---|---|---|---|
| 52-44961 | 4/1977 | Japan | 414/744 R |
| 797361 | 7/1958 | United Kingdom | 212/253 |

*Primary Examiner*—E. H. Eickholt

*Attorney, Agent, or Firm*—Hill, Van Santen, Steadman, Chiara & Simpson

[57] ABSTRACT

A walking dragline excavator massive hollow internally reinforced base frame has built-in annular rail girder means over which annular track means are carried for running thereon of roller means adapted for supporting the revolving frame on the annular track means. Load stress distribution between the base frame and the revolving frame is attained by having an annular area contiguous to the perimeter of the base frame of greater resilient flexibility than the remainder of the base frame. Means comprising either bolts or clips are provided for releasably connecting the track means to the base frame and for permitting load stress relief circumferentially directed relative movement of the track means and the base frame under load transmitted through roller means by the revolving frame during load lifting and operational revolving of the revolving frame.

31 Claims, 11 Drawing Figures

FIG. 5
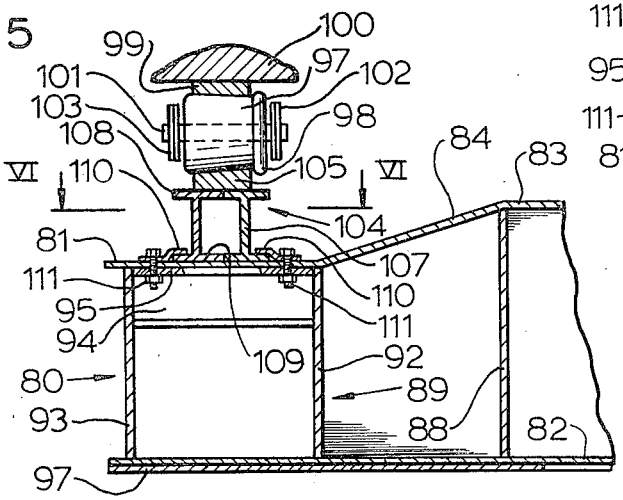
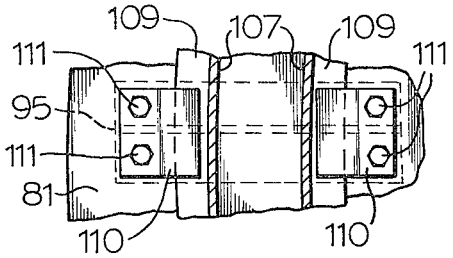
FIG. 6
FIG. 4
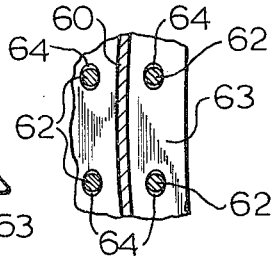
FIG. 3
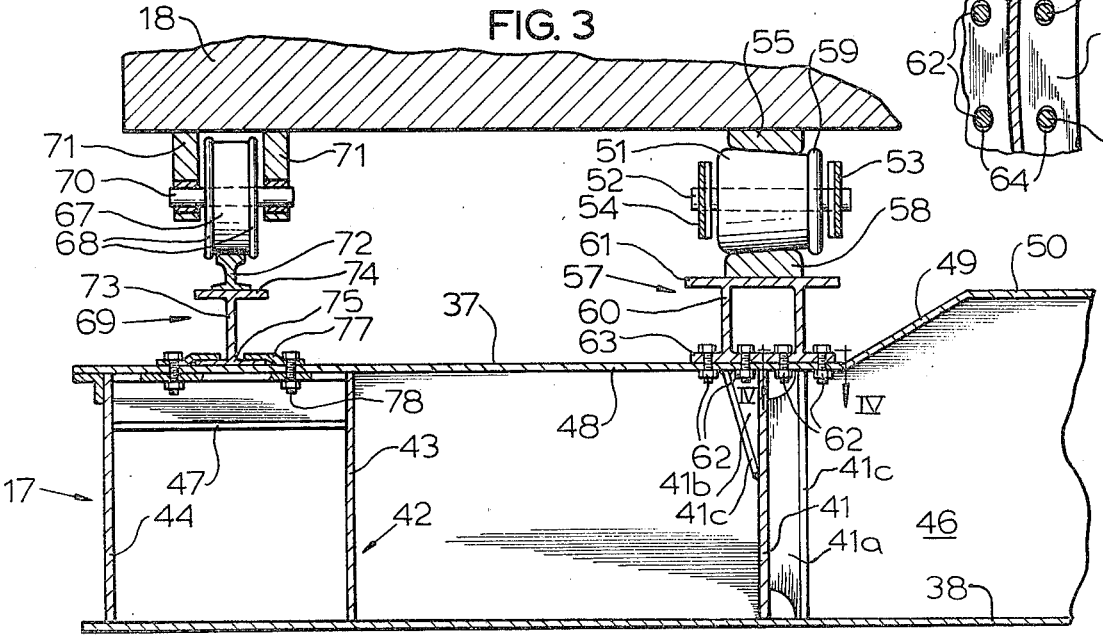
FIG. 7
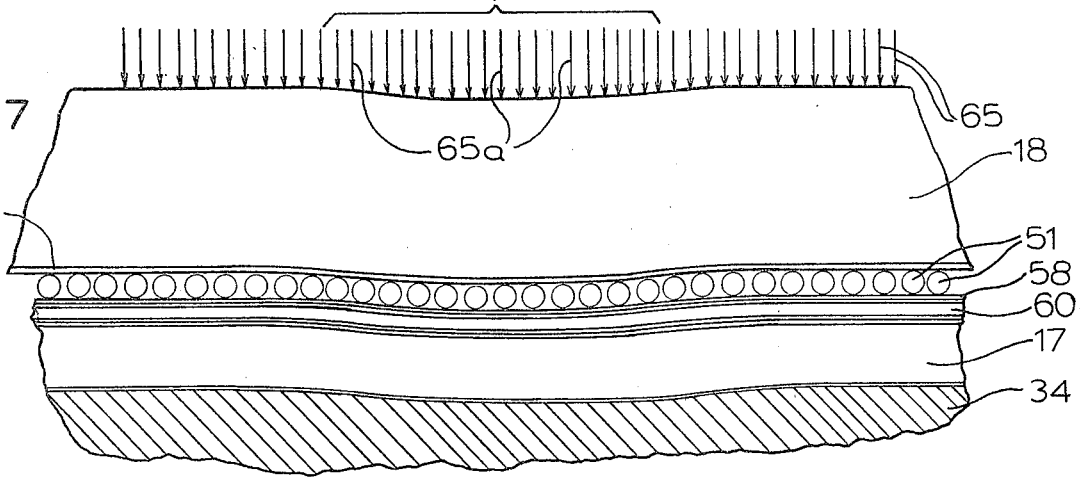

LOAD STRESS RELIEF FOR WALKING DRAGLINE EXCAVATOR BASE FRAMES

This invention relates to improvements in dragline excavators, and is more particularly concerned with attaining load stress relief for walking (as distinguished from crawler) dragline excavator base frames.

Walking dragline excavators are commonly used in strip mining operations. In about the past decade, the capacity of dragline excavators for this purpose has greatly increased. For example, up to 350 cubic yards may be handled in each bucket load. It will thus be apparent that such dragline excavators have evolved into large machinery structures having their own specific structural characteristics and problems and must be capable of withstanding massive loads. However, just about the same design principles have generally been applied to the massive load handling dragline excavators as have been applied to smaller dragline excavators. As a result, the base frames for the walking or massive load capacity dragline excavators as they have been customarily built are failing in five to twelve years before reaching their expected service life of from twenty to thirty-five years. Serious fatigue failures are occurring in the rail girders in the base frames, thereby causing excessive maintenance and replacement costs. Some recent improvements in the structural details of the rail girders have somewhat prolonged their fatigue life, but this has involved considerably increased fabrication costs. Serious fatigue failures of the rail girders still occur at unacceptably frequent intervals.

Conventionally, the rail girder is an integral part of the base frame and, therefore, is subjected in addition to triaxial stresses, also to cyclical torsional and twisting forces due to the deformations of the revolving frame carried by the base frame. Revolving frames undergo definite deformation changes during the digging phase, carrying phase and the discharging phase. The carrying phase generally involves rotation of the revolving frame. During the carrying phase deformations are imposed by the rotating revolving frame onto the base frame repeatedly in each operating cycle and cause cyclical fatigue stresses in the base frame and the rail girder.

Customary practice to prevent early fatigue failures of the rail girder, is to increase the thickness of the steel plates forming the rail girder. Welding of thick plates produces residual stresses, which may approach the yield point of material in the vicinity of the welds and has significant influence on the strength of the base frame. Therefore, although the stiffness of the base frame and the rail girder is increased, there is increased strain and stress, because in accordance with natural law the load and stress distribution in a structure is in direct proportion to the rigidity or stiffness of the individual structural elements. The stiffness ratio of the base frame to the revolving frame determines the stress levels in the base frame and the rail girder.

Detailed evaluation of the base frame failures reveals that only the upper part of the girder, equal to about one-sixth of the total girder depth, is subjected to the residual and high cyclical stresses which cause premature failure. Generally, the damaged part of the girder may comprise about 5% of the total weight of the base frame. However, the design and construction of the base frame is such that replacement of the entire base frame is often more convenient and economical than to effect repair or replacement of the damaged part of the rail girder. But in either event very high costs are involved in view of the customarily massive size of walking dragline base frames. Typically, the base frames for dragline excavators of the kind under discussion may be up to 150 feet in diameter and several feet high, and the associated structures of proportionate massive dimensions, including the revolving frame rotatably mounted on the base frame, the dragline boom and bucket as well as the counterweighting carried by the revolving frame to counterbalance the boom.

An important object of the present invention is to overcome the disadvantages, drawbacks, inefficiencies, shortcomings and problems inherent in prior walking dragline excavator base frames and to provide new and improved base frame structure and load sharing relationships between the base frame and the revolving frames of walking dragline excavators.

Another object of the invention is to improve walking dragline excavator base frames, and more particularly to reduce stress concentration and effect desirable redistribution of load stresses relative to the rail girder structure so as to prolong fatigue life of the girder and base frame.

A further object of the invention is to provide a walking dragline excavator base frame having a new and improved construction.

Still another object of the invention is to provide in walking dragline excavators new and improved roller track means and related structure which will not only efficiently relieve load stress in the base frame but will also facilitate replacing or repairing any damaged or worn parts of track means.

The present invention provides in a walking dragline excavator having a massive hollow internally reinforced base frame rotatably supporting a counterweighted revolving frame carrying boom means by which a dragline bucket is adapted to be operated through control means activated from the revolving frame, built-in annular rail girder means in the base frame concentric with and spaced substantially from an axis about which the revolving frame is adapted to rotate, annular track means carried by the base frame concentrically over the rail girder means for running thereon of roller means adapted for supporting the revolving frame on the annular track means, and means replaceably connecting the track means to the base frame and permitting load stress relief circumferentially directed relative movement of the track means and the base means under load transmitted through the roller means by the revolving frame during load lifting and operational revolving of the revolving frame, said base frame and said revolving frame having a structural relationship so that there is a load stress sharing relation of the revolving frame to the base frame in contrast to a virtually total load stress imposition on the base frame as is found in conventional structures.

The present invention also provides in a walking dragline excavator massive hollow internally reinforced base frame for rotatably supporting a counterweighted revolving frame carrying boom means by which a dragline bucket is adapted to be operated through control means activated from said revolving frame, base plate means, top plate means spaced a substantial height above said base plate means, a system of reinforcing webs and girders supporting said top plate means on said base plate means, an annular area of said base frame adjacent to the perimeter of said base frame being constructed and arranged relative to the remainder of said base frame so that an area of greater resilient flexibility is provided on said base frame contiguous to said perimeter, and annular track means carried by said annular area for running thereon of roller means adapted for supporting the revolving frame on said annular track means.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure and in which:

FIG. 3 is an enlarged fragmentary vertical sectional detail view taken substantially along the line III—III of FIG. 2;

FIG. 4 is an enlarged fragmentary sectional detail view taken substantially along the line IV—IV of FIG. 3;

FIG. 5 is a fragmentary vertical sectional detail view of a modification;

FIG. 6 is a sectional elevational plan view taken substantially along the line VI—VI in FIG. 5;

FIG. 7 is a schematic load stress diagram;

Figure 2:
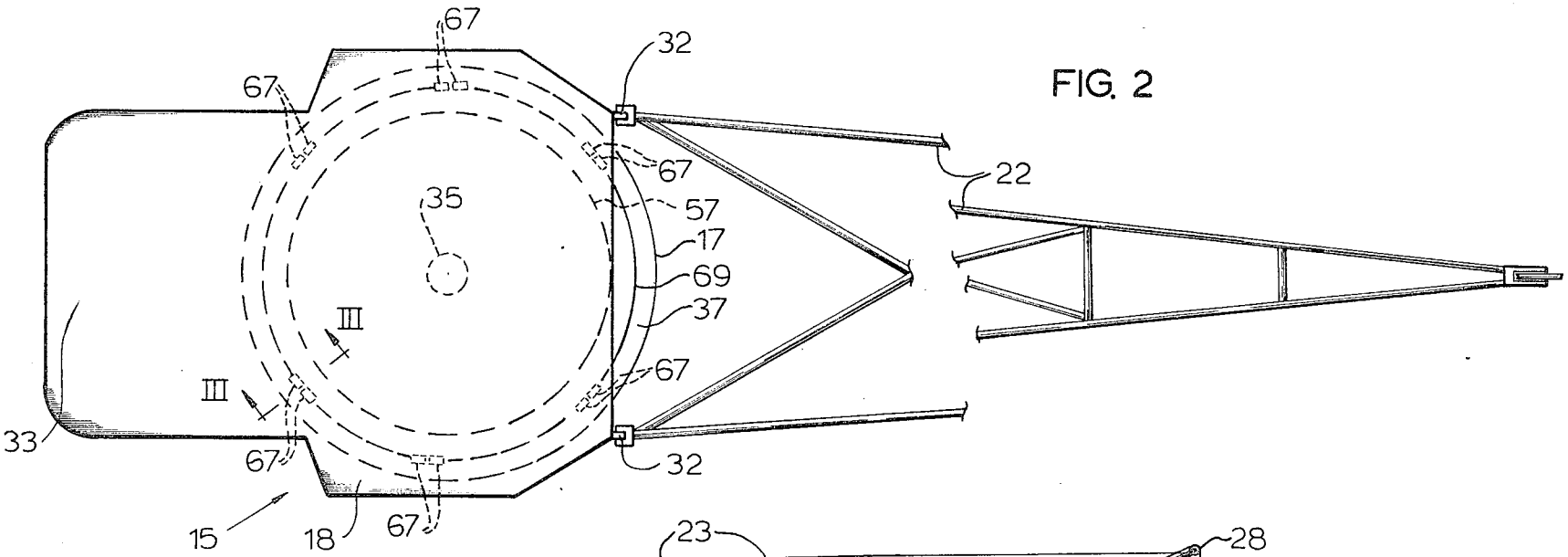
FIG. 2 is an enlarged fragmental top plan view of the excavator of FIG. 1.
Figure 1:
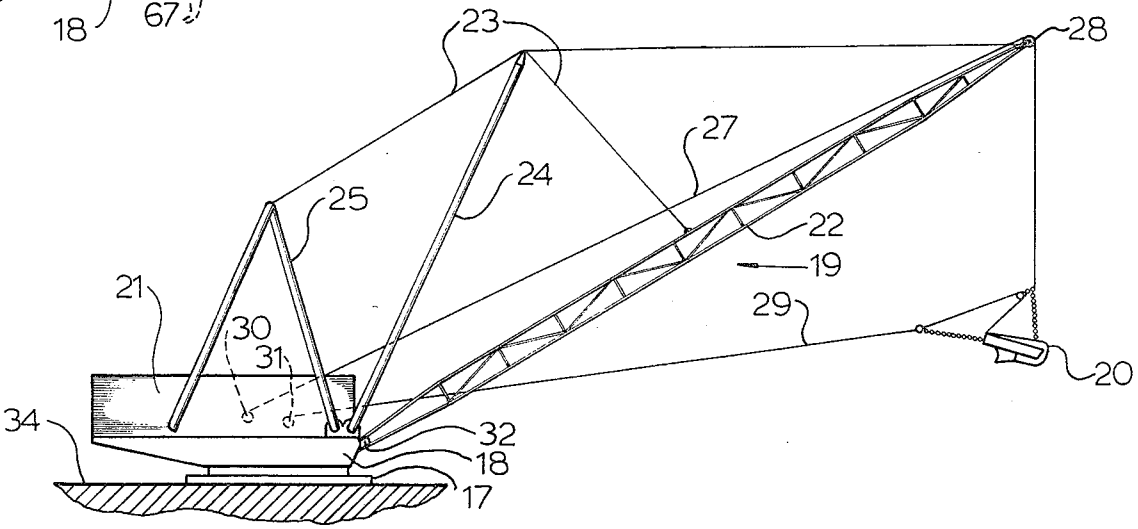
FIG. 1 is a more or less schematic side elevational view of a walking dragline excavator embodying the invention.

Referring to FIGS. 1 and 2, a typical, schematically illustrated, walking dragline excavator 15 comprises a base frame 17 supporting a revolving counterweighted frame 18 carrying boom means 19 by which a dragline bucket 20 is operated through suitable control means activated from the revolving frame. Conventional walking means (not shown) may be provided for raising and moving the excavator 15 when necessary. A housing 21 on the revolving frame may enclose operating machinery, controls, power source, and the like as is customary with dragline excavators of this type. The boom means 19 comprises a boom 22 controlled by a cable system 23 operated from the control housing 21 and trained over a mast 24 and a gantry frame 25. For operating the dragline bucket 20, a hoisting cable or rope 27 is trained over a pulley 28 at the top of the boom 22 and suspends the bucket 20 therefrom. A drag cable or rope 29 is attached to the bucket 20 in usual operating fashion. Operating drums 30 and 31 in and in association with the housing 21 operate the hoisting rope 27 and the drag rope 29, respectively, as controlled by the operator who is suitably accommodated in or in association with the housing 21. As is customary the boom 22 is pivotally attached for vertical swinging movement to a front end of the revolving frame 18 as by means of pivot knuckles 32. At its rear end the base frame 18 has a platform area 33 on which may be carried suitable counterweight means (not shown). The base frame 17 may be, as is usual, of circular form and adapted to lie directly on a ground surface 34. At about its center of weight, the revolving frame 18 may be pivotally connected as at 35 (FIG. 2) on the vertical axis of the base frame 17 for rotary driving.

Figure 8:
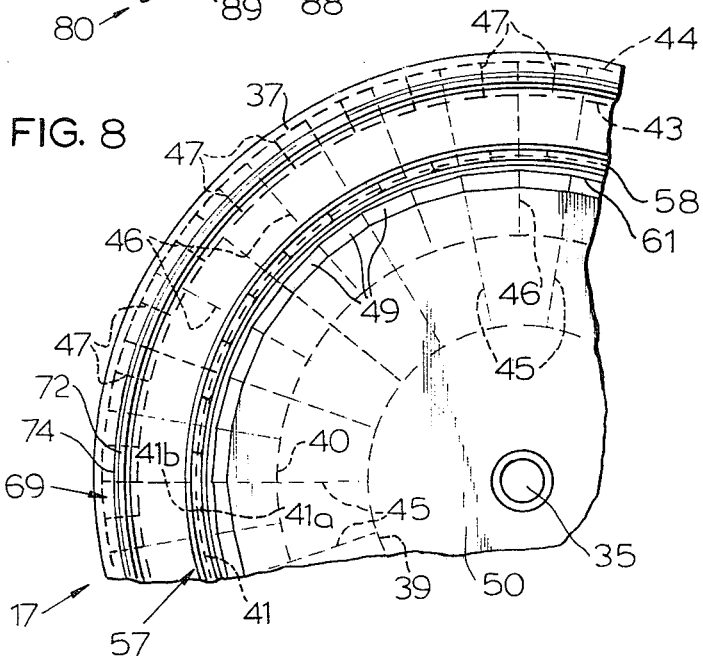
FIG. 8 is a schematic fragmentary plan view of the base frame of FIG. 3.

New and improved means are provided for transferring dead load and operating load from the revolving frame 18 to the base frame 17 in a manner to attain advantageous stress handling cooperation between the base frame and the revolving frame. To this end, in one preferred embodiment (FIGS. 2 and 3), the base frame 17 has an annular marginal area 37 which is constructed and arranged relative to the remainder of the base frame so that an area of greater resilient flexibility is provided on the base frame contiguous to its perimeter. Although this may be effected by differential rigidity of internal structure in the base frame, it may also be effected by constructing the area 37 of reduced height, that is, inset on its top surface relative to the remainder of the base frame and thus of reduced stiffness relative to the remainder of the base frame. As is customary, the base frame 17 is of a welded heavy steel plate construction. To this end, referring to FIGS. 3 and 8, a base plate 38 has welded thereto an inner annular upright girder 39, a radially outwardly spaced intermediate annular upright girder 40, radially outwardly spaced from which is an upright annular girder 41 located under the radially inner portion of the inset area 37. Under the radially outer portion of the inset area 37 is located an upstanding box girder structure 42 comprising an annular upright inner annular girder member 43 and an annular radially outer upright girder member 44. Extending radially and connected rigidly to all of the girder members 39, 40, 41, 43 and 44 are circumferentially equally spaced radially extending upright plate webs 45. In the radially outwardly widening space intermediate each pair of the plate webs 45, is a radially extending upright plate web 46 rigid with and extending to and between all of the annular girder members 40, 41, 43 and 44.

The box girder 42 is additionally reinforced and stiffened by means of radially extending stiffners 47 desirably in the form of I-beam or equivalent sections extending between the upper end portions of the box girder web members 43 and 44, and preferably equally circumferentially spaced between each of the plate webs 45 and 46. The reinforcing stiffners 47 are functionally integrally welded at their ends to respectively the girder members 43 and 44. The top plane of each stiffner 47 preferably underlies the superimposed annular portion of the area 37 which comprises part of a top plate structure 48 for the frame 17.

It will be apparent, of course, that all of the girder members 39, 40, 41, 43 and 44, as well as all of the plate webs 45 and 46 are also supportingly related at their upper edges to the top plate 48. While the top plate 48 may be formed from one solid plate panel, in practice it may be constructed from an assembly of plate sections welded to one another and to the underlying supporting members including all of the upright girder members, plate webs and the stiffners 47. Along the inner edge of the area 37, the top plate structure 48 may have upwardly and inwardly sloping angular offsetting sections 49 joining a maximum height inner area 50 of the top plate 48. The sections 49 are desirably connected together at their ends which at the end connections overlie and are integrally welded to the complementary upper edges of the plate webs 45 and 46, as best visualized in FIG. 8. Where insetting of the area 37 is not desired, the entire plane of the top plate 48 may be substantially flat.

Revolving of the upper or revolving frame 18 is facilitated by roller means which may comprise a continuous, closely spaced, annular, roller circle series of tapered lubricated rollers 51 which mutually cooperate with one another in load supporting relation concentrically about the vertical axis of the base frame 17. Each of the rollers 51 has an axial shaft 52 extending therethrough and connected at opposite end portions to similar radially inner and radially outer spacer or cage rings 53 and 54, respectively. Load from the revolving frame 18 is imposed on the rollers 51 through an upper annular rail 55 having a roller-engaging lower face tapered complementary to the radially inwardly diminishing taper of the rollers 51 to facilitate running in a circle. Load is transmitted from the rollers 51 to the base frame 17 and more particularly to the radially inner portion of the area 37 through annular track means 57 carried by the base frame concentrically over the girder 41 which serves as rail girder means. Direct thrust of the rollers 51 toward the base frame 17 is applied to an underlying rail 58 having an upper face complementary to the bevel of the rollers 51 and cooperating with the upper rail 55 for tracking of the rollers 51. Each of the rollers 51 has at its inner end a radial flange 59 which opposes the radially inner edges of the rails 55 and 58.

Advantageously, the track means 57 are constructed and arranged for ready removal and replacement, and also to provide additional load-sustaining reinforcement for the rail 58. To this end an annular rail pad or beam 60 (FIG. 3) underlies and provides direct support for the lower rail 58 which is desirably replaceably secured as by clips (not shown) to the top of the beam 60.

In a preferred construction, the rail beam 60 is of box beam transverse cross-section and, while it may be formed-up in any suitable fashion as by welding plates together, may be formed-up from originally I-beam sections having abutting flange edges secured permanently together as by welding to produce the box beam section. Although the rail beam 60 may be a continuous circular structure on the rail circle, it may comprise a series of segmental lengths cooperatively related in end-to-end relation. In assembly with the base frame 17, the rail beam 60 is desirably coaxially centered over the girder 41 which thus serves as a fixed rail girder. Although in FIG. 3, the girder member 41 is disclosed as of a single web type, it may if preferred be of the box-type wherein two or more web plate members similar to the girder 42, may be located in spaced relation to one another under the rail beam 60. In the single web form of the girder 41, reinforcing stress relieving means for balanced load distribution to the girder may be provided in the spaces between the web plates 45 and 46, comprising a vertical strut **41*a* welded to the radially inner side of the girder 41 and a vertical strut 41*b* welded to the radially outer side of the girder 41. Each of the struts 41*a* and 41*b* is preferably of elongate form vertically and of T-cross section transversely with a T-head flange 41*c* thereof in load supporting relation at its upper end to the respective overlying web of the rail beam 60. At their upper ends at least, the struts 41*a* and 41*b* are in engagement with the top plate 48** and may be welded thereto.

By having the rail beam 60 replaceably secured in place on the radially inner portion of the area 37 of the top plate 48, any repairs that may become desirable in respect to the track means 57 can be readily accomplished economically. However, the likelihood of requiring repair or replacement of the track means 57 over a long operating life is greatly minimized by the particular structural relationships whereby bending moments and stresses due to the roller loads are distributed between the rail beam 60 and the built-in rail girder 41 in direct proportion to their stiffness. The desired stiffness of the rail beam 60 is adapted to be selected to limit bending stresses to a desired level and prevent premature failure. By having a top flange 61 on the rail beam 60, supporting the rail 58 above and independently of the top plate 48 except for load transmission through the beam 60, bi-axial bending of the top flange 61 is eliminated. Location of the rail beam 60 efficiently over the rail girder 41 distributes concentrated roller loads uniformly to the rail girder 41.

Replaceable attachment of the rail beam 60 to the top plate 48 is desirably effected by means of bolts 62 extending through a base flange 63 of the beam 60 and through the portion of the top plate 48 on which the beam 40 is mounted. The attachment is effected in a manner to permit load stress relief circumferentially directed relative to movement of the track means 57 and the base frame 17 under load transmitted through the rollers 51 by the revolving frame during load lifting and operational revolving of the revolving frame 18. To this end, the shanks of the bolts 62 extend through bolt holes 64 in the base flange 63 (FIG. 4), and the bolt holes 64 are elongated in the longitudinal direction of the beam 60. Desirably such elongation of the bolt holes 64 extends in both directions longitudinally of the beam 60 relative to the shank of each of the bolts 62. As a result, load stress relief circumferentially directed relative movement of the track means and the base frame is permitted.

By way of graphic example, FIG. 7 indicates in highly exaggerated form how the base frame 17 and the revolving frame 18 undergo deformation changes during the digging phase, the carrying phase and the discharging phase in operation of the dragline excavator 15 as a result of concentrated loading about the track circle. Directional arrows 65 indicate normal load imposition. Within the ambit of the bracket P, the directional arrows **65*a* indicate concentrated load imposition which causes a downward deformation of the revolving frame 18 and the base frame 17 and the intermediate structure comprising the rail beam 60. As a matter of fact, deflection may be only on the order of a fraction of an inch. The portion of entire load 65 resisted by the revolving frame 18, girder 57 and base frame 17 is in direct proportion to the stiffness ratio of 18:57:17. In a structure intended to be rigidly unyielding, the tri-axial stresses, cyclical torsional and twisting forces imposed repeatedly in each operating cycle may eventually cause fatigue failure in the base frame and the built-in rail girder. However, by virtue of the capability of relative circumferentially directed movement between the track means 57 and the base frame 17, and more particularly the more resilient thinner section radially outer area of the base frame 17 represented by the area 37, facilitated by the relative sliding movement between the rail beam flange 63 and the underlying top plate 48, provides such efficient load stress relief as practically to preclude load stress damage to the base frame and more particularly the rail girder 41. As any incremental part of the track means 57 and the underlying base frame deflect downwardly under localized load, and then recover by returning upwardly, the rail beam 60, and more particularly its lower flange 63, is free to slide relative to the underlying surface of the upper plate 48** in load stress relief circumferentially directed relative movement.

If, for any reason, the roller circle cannot be located as close as desirable to the outer edge of the base frame 17, auxiliary rollers 67 (FIGS. 2 and 3) which may be in the form of crane wheels having radial flanges 68 at their opposite ends, are carried by the revolving frame 18 and run on annular track means 69 carried by the base frame 17 as close as practicable to the outer edge of the base frame. In the preferred arrangement, the auxiliary roller circle is aligned substantially centrally over the box girder 42 for uniform load distribution to the box girder. Each of the auxiliary rollers 67 desirably has an axial shaft 70 mouted to spaced bearing blocks 71 on the underside of the revolving frame 18. Although the auxiliary rollers 67 may be located at uniform intervals along the auxiliary roller circle, inasmuch as the auxiliary rollers are only supplemental to the principal load bearing rollers 51, the auxiliary rollers may be located at substantially spaced desirable locations along the auxiliary roller circle, such as indicated in FIG. 2 where the auxiliary rollers are arranged in circumferentially spaced pairs and the pairs of roller suitably spaced on the auxiliary roller circle.

A construction similar to the track means 57 may be employed in the track means 69. To this end a crane rail 72 may be mounted on a rail pad or beam 73 which may conveniently be an I-beam having an upper horizontal flange 74 on which the rail 72 is supported, and a lower horizontal flange 75 which rests on the surface 37 of the plate 48. If preferred, the flange 75 may be attached to the plate 48 by means of bolts similarly as the flange 63 of the rail beam 60. However, since the rail beam 73 serves only as an auxiliary, a desirable arrangement to secure the beam 73 in place, while nevertheless permitting load stress relief circumferentially directed relative movement of the track means 69 and the base frame 17 under load transmitted through the roller means 67 by the revolving frame 18 during load lifting and operational revolving of the revolving frame, has retaining clips 77, releasably secured as by means of bolts 78 to the plate 48 and the stiffner 47, clampingly engage the lower flange 75 to the plate 48. Through this arrangement, relative sliding movement is permitted between the track beam 73 and more particularly the flange 75 and the engaged surface of the top plate 48 during flexing of these structures. As a result, similarly as in the case with respect to the attachment of the rail beam 60 to the plate 48, the rail beam 73 is adapted to flexibly bend, and shear load transfer to the base frame 17 is avoided. The reinforcing stiffeners 47 and the web plates 45 and 46 distribute the roller load to the two girder members 43 and 44, thus reducing the required thickness of the members 43 and 44 and reducing the residual stresses.

An important advantage of the auxiliary roller means 67 and track means 69 in the relatively wide flexible area 37 of the base frame 17 is the control against upward deflection of the base frame at its outer edge as a result of the loads imposed through the rollers 51 and the rail means 60, resulting in reduced bending stresses. Further, location of the auxiliary roller means 67 is selected to accommodate the structural characteristics of the revolving frame 18 and the base frame 17 and may be utilized to transmit loads of the revolving frame 18 directly to the base frame 17, thus sharing and reducing loads on the rail means 57.

In keeping with the desirability of locating the principal load bearing roller circle as close as practicable to the outer edge of the base frame, and where circumstances permit, an arrangement as depicted in FIGS. 5 and 6 may be adopted. In this instance, a base frame 80 in general comprises a construction similar to the base frame 17 but with a more flexible radially outer area 81 substantially narrower than the top area 37, and inset below the remainder of the top plate if necessary. Otherwise, the overall structure of the base frame 80 may be substantially the same as the base frame 17, that is, comprising a base plate structure 82, a top plate structure 83, sloping offsetting area or areas 84 connecting the maximum height area of the base frame with the depressed or inset area 81, and an internal thoroughly reinforced construction of webs and girders as best visualized in FIG. 9. A concentric radially spaced series of annular upright girders between the base plate 82 and the top plate 83 comprises a radially innermost annular girder 85 concentrically about a rotary axis and turning gear post 84. Radially outwardly spaced from the annular girder 85 is a larger diameter girder 87 about which is an even larger diameter radially outwardly spaced annular girder 88 from which is radially outwardly spaced an annular box girder 89. Extending radially to and connecting all of the girder 85, 87, 88 and 89, and the bottom and top plates 82 and 83 are radially extending circumferentially spaced plate webs 90. Between the widest spread of the plate webs 90, reinforcing upright radially extending plate webs 91 extend to and between the girders 87, 88 and 89 and the bottom and top plates 82 and 83. The box girder 89 may be of similar construction as the box girder 42, and comprises an upright annular radially inner girder member 92, and substantially spaced radially outer annular upright girder 93. At regular intervals between the widest spreads of the radial webs 90 and 91, radially extending reinforcing beams 94, preferably in the form of I-beam sections are welded at their ends to the girder members 92 and 93 and have respective upper flanges 95 abutting and desirably welded to the underside of the area 81 of the top plate 83. An annular wear plate 97 may be welded onto the bottom of the bottom plate 82 in a radial span extending under the girders 88 and 89.

Load supporting roller means in a roller circle substantially centered on the top area 81 and comprising radially inwardly tapered flanged rollers 97 having annular rail opposing respective flanges 98 are engaged by a complementary tapered rail 99 on the bottom of a revolving heavy duty dragline excavator frame 100. To maintain the rollers 97 in proper series orientation, the rollers 97 have axial shafts 101 connected to respective radially inner and radially outer cage rings 102 and 103. Load transmission from the rollers 97 to the base frame 80 is effected through annular track means 104 comprising a complementally tapered rail 105 on which the rollers ride and which rail is supported by a rail pad beam 107 carried by the top area 81 of the base frame 80. In this instance, similarly as with respect to the rail beam 60, the rail beam 107 is desirably constructed as a hollow box beam which may be formed-up from a pair of I-beams having their contiguous upper and lower flange edges welded together, providing a common upper flange 108 on which the rail 105 is centered and secured as by means of clips (not shown). A lower combined flange 109 of the box beam rests upon the surface area 81 in a preferably free sliding frictional relation in order to attain load stress relief circumferentially directed relative movement of the track means 104 and the base frame 80 under load transmitted through the roller means 97 by the revolving frame 100 during load lifting and operational revolving of the revolving frame 100. Inasmuch as location of the roller ring close to the outer edge of the base frame 80 affords more flexibility in the entire base frame and actually reduces the stiffness of the base frame, this leads to the utilization of the rigidity and strength of the revolving frame 100. The reinforcing stiffeners 94 and the web plates 90 and 91 distribute the roller load to the two girder members 92 and 93, thus reducing the required thickness of the members 92 and 93 and reducing the residual stresses.

Although if preferred, the rail beam 107 may be bolted to the top plate area 81, similarly as effected by means of the screws 62 for the rail beam 60, a retaining clip arrangement similarly as for the auxiliary track means 69 may be employed. To this end, radially oppositely extending portions of the bottom flange 109 are retainingly secured to the top area 81 by means of respective clips 110 which overlap the bottom flange 109 in frictional engagement and are replaceably secured as by means of bolts 111 to the top area 81 and desirably also to the top flange 95 of the stiffner beam 94 underlying the area 81 in each instance.

Figure 9:
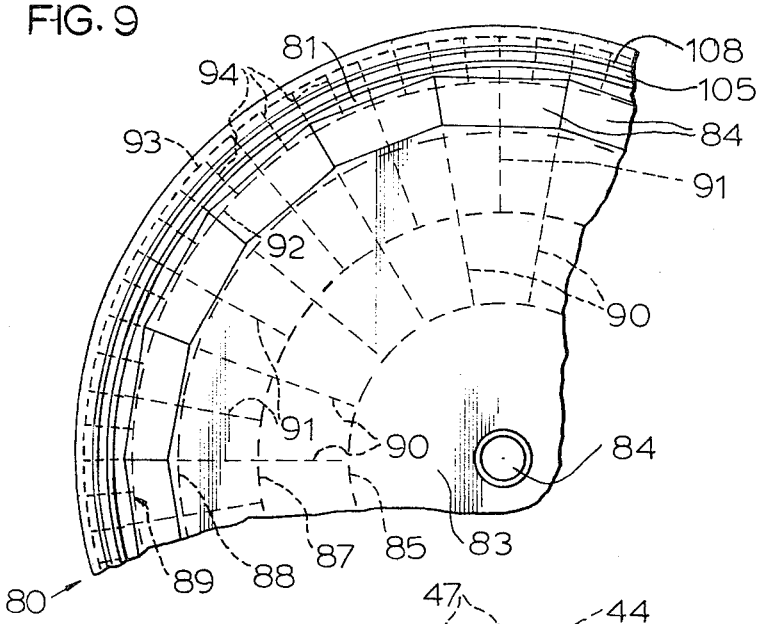
FIG. 9 is a fragmentary schematic plan view of the base frame of FIG. 5.
Figure 11:
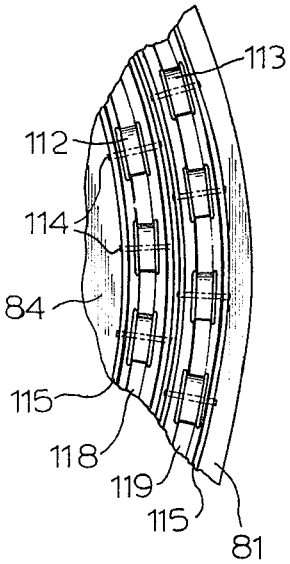
FIG. 11 is a schematic top plan view taken substantially along the line XI—XI of FIG. 10.
Figure 10:
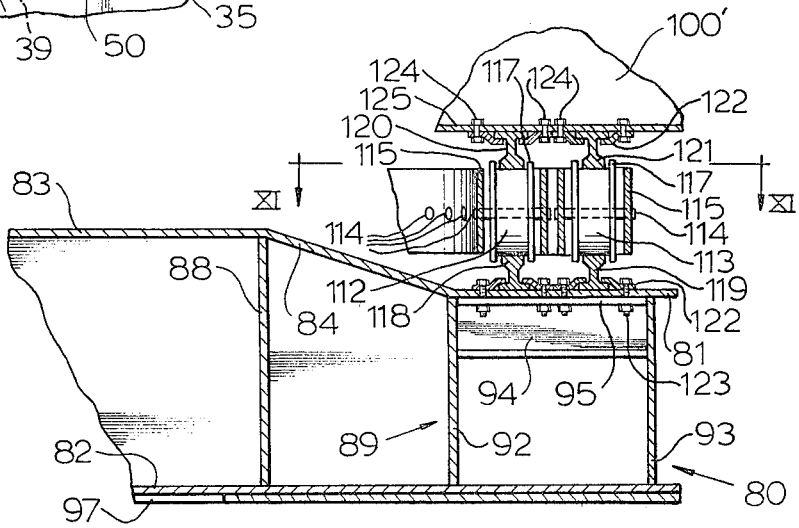
FIG. 10 is a fragmentary vertical sectional detail view showing a further modification.

In the modification of FIGS. 10 and 11, the structure of the base frame 80 is substantially the same as in FIGS. 5 and 9 and the parts are similarly identified and the description thereof will not be repeated. In FIGS. 10 and 11, however, a plurality of annular roller series are provided on the rail circle centered over the annular radially outer base frame area 81 and the box beam 92. A radially inner annular series of circumferentially spaced roller means 112 and a radially outer annular series of circumferentially spaced roller means 113 is provided, and the rollers of each series are uniformly staggered with respect to the rollers of the other series. The roller series 112 and 113 may comprise crane wheels having radially inner and radially outer annular tracking flanges and respective axial shafts 114 connected to respective radially inner and radially outer cage rings 115 and 117 for each series of the rollers. To attain the staggered relationship, the rollers 112 in the inner series and the rollers 113 in the outer series are of equal number in each series and spaced apart substantially equally in each series, although as will be apparent from FIG. 11, the roller spacing in the inner series must be proportionately smaller than the roller spacing in the outer series due to the differential diameters of the two series.

In FIGS. 10 and 11 both the base frame 80 and the revolving frame 100' have annular track means concentrically over the box beam 89 which serves as rail girder means. For this purpose, annular track means carried by the base frame 80 and more particularly the area 81 comprises respective annular crane rails 118 and 119, respectively, engaged in running relation by the rollers 112 and 113. To similar effect, annular concentric crane rails 120 and 121 carried by the underside of the revolving frame 100' engage the rollers 112 and 113, respectively, in running relation. The base flanges of the rails 118, 119, 120 and 121 are preferably attached to the respective frames 80 and 100' by means of retaining clips 122. Attachment of the retaining clips for each opposite side of the base flanges of the rails 118 and 119 is desirably effected replaceably as by means of bolts 123 securing the clips to the top plate area 81 and the top flange 95 of the underlying reinforcing beam 94. Attachment of the retaining clips 122 at each side of the base flange of each of the rails 120 and 121 is desirably effected replaceably as by means of bolts 124 to a base plate 125 on the underside of the revolving frame 100'. Through this arrangement, the track means comprising the rails 118 and 119 on the base frame 80 and the track means 120 and 121 on the revolving frame 100' are replaceably connected and permit load stress relief circumferentially directed relative movement of the track means on both the base frame and the revolving frame under load transmitted to and through the roller means by the revolving frame during load lifting and operational revolving of the revolving frame 100'.

The two series of rollers 112 and 113 contain in total twice the number of rollers that could be accommodated on a single rail. Therefore, the load per roller is only one-half of what it would be in a one rail arrangement. By having the rollers 112 and 113 staggered, the result is more evenly distributed and smaller roller loads resulting in lower unit stresses in the base frame girder 89.

From the foregoing, it will be apparent that the present invention provides substantial improvements in the structure and relationship of walking dragline excavator base frames and rotatably supported revolving frames. An efficient and advantageous distribution of load stresses is attained. In particular, stresses in the base frame are reduced as compared to prior practice by incorporation of greater resilient flexibility in the perimeter areas of the base frame. The strength and stiffness of the revolving frame is adapted to be utilized in a load stress distribution sharing relation to the base frame. By having the track means replaceable, wear or possible failure in any point in a long useful operating life are adapted to be absorbed in the replaceable track means system which can be easily replaced or repaired at minimum cost as compared to repairs to the base frame. By reducing the rigidity or stiffness of the base frame in the area to which loads are transmitted from the revolving frame, strain and stress on the entire base frame are reduced.

It will be understood that variations and modifications may be effected without departing from the spirit and scope of the novel concepts of this invention.

I claim as my invention:

1. In a walking dragline excavator having a massive hollow internally reinforced base frame rotatably supporting a counterweighted revolving frame carrying boom means by which a dragline bucket is adapted to be operated through control means activated from said revolving frame:

built-in annular rail girder means in said base frame concentric with and spaced substantially from an axis about which the revolving frame is adapted to rotate;

annular track means carried by said base frame concentrically over said rail girder means for running thereon of roller means adapted for supporting the revolving frame on said annular track means;

means replaceably connecting said track means to said base frame and permitting load stress relief circumferentially directed relative movement of said track means and said base frame under load transmitted through the roller means by the revolving frame during load lifting and operational revolving of the revolving frame;

and said base frame and said revolving frame having a structural relationship so that there is a load stress sharing relation of the revolving frame to the base frame in contrast to a virtually total load stress imposition on the base frame.

2. An excavator according to claim 1, wherein said base frame is of substantial vertical dimension having an annular area contiguous its perimeter and on which said track means are carried, said area being relatively more resiliently flexible than the remainder of the base frame.

3. An excavator according to claim 1, wherein said built-in annular rail girder means comprises a vertical girder member centrally underlying said annular track means in supporting relation.

4. An excavator according to claim 1, wherein said built-in annular rail girder means comprises a box girder having concentric annular upstanding girder members, and means between the upper ends of said girder members for supporting said track means.

5. An excavator according to claim 4, wherein said supporting means comprise radially extending stiffening beams.

6. An excavator according to claim 5, wherein a top plate intervenes between said annular track means and said stiffening means.

7. An excavator according to claim 1, wherein said base frame comprises a base plate structure, a top plate structure, a plurality of radially spaced concentric annular girders extending between and fixed to said bottom plate and said top plate, a circumferentially spaced series of radially extending reinforcing webs extending to and between said top and bottom plates and said girders, the radially outermost of said girders comprising a box girder having radially inner and outer upstanding girder members, and stiffening beams extending between and connected to said box girder members and supportingly underlying said top plate in the area thereof which overlies said box girder, said track means being supported by said portion of said top plate which overlies said stiffening beams.

8. An excavator according to claim 1, wherein said rail girder means and said track means are located a substantial distance inwardly from the perimeter of said base frame, and auxiliary annular track means carried by said base frame outwardly radially spaced from said first mentioned annular track means and adapted for running thereon of auxiliary revolving frame roller means.

9. An excavator according to claim 1, wherein said annular track means comprise annular rail means, annular rail beam means supporting said rail means, said replaceably connecting means connecting said rail beam means to said base frame.

10. An excavator according to claim 9, wherein said rail beam means comprise base flange structure having longitudinally elongate bolt holes, and bolts extending through said bolt holes and securing said flange structure replaceably to said base frame.

11. An excavator according to claim 9, wherein said rail beam means has base flange means frictionally engaging said base frame, and said replaceably connecting means comprising clips clamping said flange means to said base frame, and means attaching said clips replaceably to said base frame.

12. An excavator according to claim 1, wherein said annular track means comprises an annular rail having base flange means, and said releasably connecting means connecting said rail flange means to said base frame.

13. An excavator according to claim 1, wherein said annular track means comprise a plurality of concentric adjacently spaced annular rails adapted for running thereon of concentric radially spaced cooperating annular series of revolving frame supporting rollers.

14. An excavator according to claim 1, wherein said revolving frame has track means concentrically overlying said base frame track means, and said base frame track means and said revolving frame track means engage rollers running therebetween.

15. An excavator according to claim 1, wherein said revolving frame carries auxiliary roller means spaced radially outwardly from and on a roller circle concentric with said annular track means, and said base frame has an annular auxiliary track structure engaged by said auxiliary roller means, and means replaceably connecting said track structure to said base frame.

16. An excavator according to claim 1, wherein said track means are located closely adjacent to the perimeter of said base frame, and said built-in annular rail girder means comprise a reinforced box girder assembly having stiffening means supportingly underlying said base frame track means.

17. An excavator according to claim 14, wherein both said base frame track means and said revolving frame track means comprise crane rails and said rollers means comprise crane wheels in running engagement with said crane rails.

18. An excavator according to claim 2, including annular wear plate means on the bottom of said base frame under said annular area.

19. An excavator according to claim 3, including strut means fixed to said vertical girdle member for balancing load distribution into the girder from said track means.

20. In a walking dragline excavator massive hollow internally reinforced base frame for rotatably supporting a counterweighted revolving frame carrying boom means by which a dragline bucket is adapted to be operated through control means activated from said revolving frame:

base plate means;

top plate means spaced a substantial height above said base plate means;

a system of reinforcing webs and girders supporting said top plate means on said base plate means;

an annular area of said base frame comprising the perimeter of said base frame being constructed and arranged relative to the remainder of said base frame so that said area provides greater resilient flexibility of said base frame contiguous to said perimeter;

and annular track means carried by said annular area for running thereon of roller means adapted for supporting the revolving frame on said annular track means.

21. A base frame according to claim 20, including annular girder means within said annular area of said base frame supportingly underlying said track means.

22. A base frame according to claim 21, wherein said annular girder means comprise a box girder having radially spaced girder members, and stiffening beams extending radially between and rigidly secured to the upper portions of said girder members and providing support for said track means.

23. A base frame according to claim 22, wherein said track means comprise a plurality of annular radially spaced rails for running thereon of an equal number of annular revolving frame supporting roller series.

24. A base frame according to claim 20, including means for releasably connecting said track means to said base frame area and permitting load stress relief circumferentially directed relative movement of said track means and said base frame area under load transmitted through the roller means by the revolving frame during load lifting and operational revolving of the revolving frame.

25. A base frame according to claim 24, wherein said releasably connecting means comprise bolts, and means permitting relative circumferential movement of said track means and said bolts.

26. A base frame according to claim 24, wherein said releasably connecting means comprise clips frictionally clamping said track means to said base frame.

27. A base frame according to claim 20, including annular built-in rail girder means comprising an annular upright girder member centrally disposed in supporting relation under said annular track means.

28. A base frame according to claim 27, including strut means fixed to said vertical girder member for balancing load distribution into the girder from said track means.

29. A base frame according to claim 20, including an annular wear plate under the base plate means below said area.

30. In a walking dragline excavator massive hollow internally reinforced base frame for rotatably supporting about a rotary axis a counterweighted revolving frame carrying boom means by which a dragline bucket is adapted to be operated through control means activated from said revolving frame:

base plate means;

top plate means spaced a substantial height above said base plate means;

a system of reinforcing webs and girders supporting said top plate means on said base plate means;

an annular area of said base frame adjacent to the perimeter of said base frame being constructed and arranged relative to the remainder of said base frame so that an area of greater resilient flexibility is provided on said base frame contiguous to said perimeter;

and annular track means carried by said area for running thereon of roller means adapted for supporting the revolving frame on said annular track means;

an annular area of said base frame substantially spaced concentrically about said axis carrying annular track means for running thereon of roller means adapted for supporting the revolving frame on said annular track means;

annular box girder means within said base frame supportingly underlying said track means and having radially spaced girder members;

and stiffening beams extending radially between and rigidly secured to the upper portions of said girder means and providing support for said track means.

31. A base frame according to claim 30, wherein said box girder means has radially extending upright plate webs at circumferentially spaced intervals, and said stiffening beams are located in the spaces between adjacent ones of said webs.

* * * * *